United States Patent [19]

Andrew et al.

[11] 4,107,918

[45] Aug. 22, 1978

[54] COMBUSTION ASSEMBLY

[75] Inventors: Gordon Edward Andrew, Burnley; George Edward Bunn, Clitheroe, both of England

[73] Assignee: Lucas Industries Limited, Birmingham, England

[21] Appl. No.: 739,743

[22] Filed: Nov. 8, 1976

[30] Foreign Application Priority Data

Nov. 7, 1975 [GB] United Kingdom ..... 46152/75

[51] Int. Cl.[2] ..... F02G 1/00

[52] U.S. Cl. ..... 60/39.71; 60/39.74 R

[58] Field of Search ..... 432/222; 60/39.71, 39.74 R

[56] References Cited

U.S. PATENT DOCUMENTS

| | | | |
|---|---|---|---|
| 2,685,168 | 8/1954 | Malick | 60/39.74 R |
| 2,879,837 | 3/1959 | Downs | 432/222 |
| 3,064,720 | 11/1962 | Keating | 432/222 |
| 3,802,192 | 4/1974 | Curran | 60/39.74 R |
| 3,961,475 | 6/1976 | Wood | 60/39.71 |

*Primary Examiner*—Carroll B. Dority, Jr.
*Attorney, Agent, or Firm*—Holman & Stern

[57] ABSTRACT

A combustion assembly, particularly for a gas turbine engine, comprises a unitary baffle disposed in an axial inlet opening of a flame tube, which baffle has a plurality of air admission apertures extending therethrough and a plurality of fuel spraying devices mounted thereon. Each fuel spraying device includes a body having co-axial air and fuel passages therein, these passages communicating with outlet passage in the body through which, in use, a mixture of air and fuel is ejected. The fuel spraying devices are mounted on the baffle so that the outlet passages are disposed on a downstream side of the baffle, and also the fuel spraying devices are disposed between the air admission apertures to ensure substantially uniform mixing of the said mixture of air and fuel and air passing through the apertures in use.

6 Claims, 4 Drawing Figures

FIG. 2.
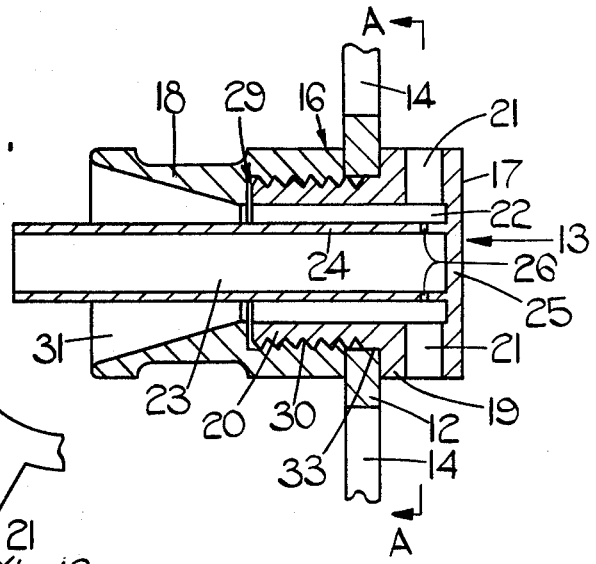
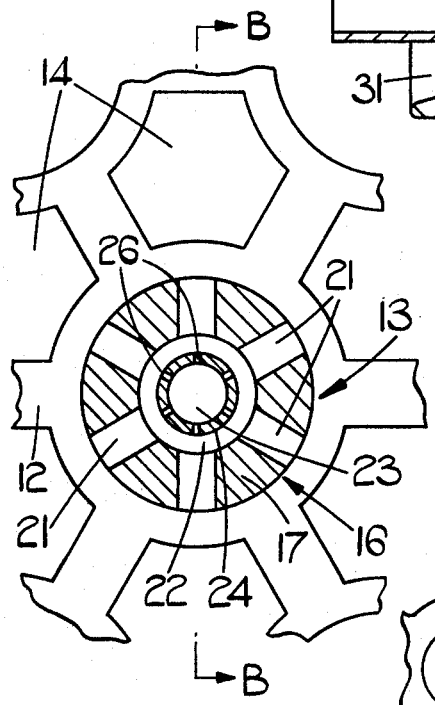
FIG. 3.
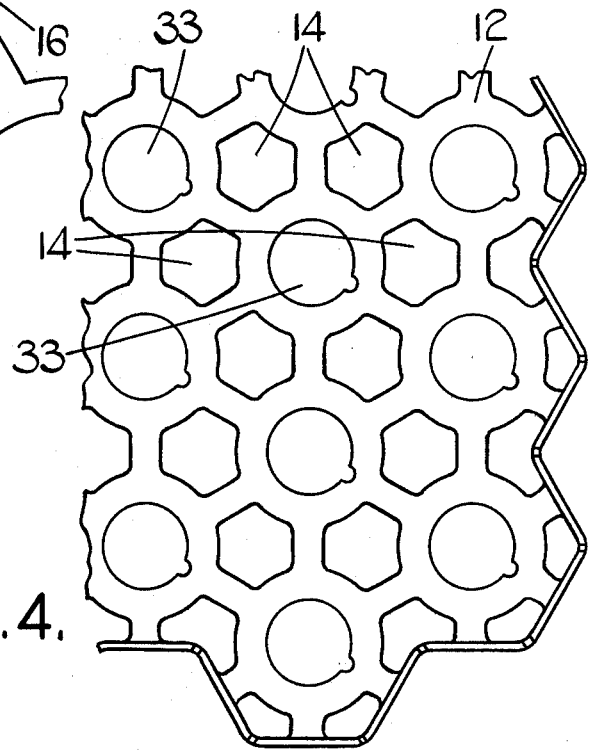
FIG. 4.

COMBUSTION ASSEMBLY

This invention relates to a combustion assembly, and more particularly, though not exclusively, to a combustion assembly for a gas turbine engine.

According to the present invention, there is provided a combustion assembly comprising a plurality of fuel spraying devices, each of which includes a body having air and fuel passages therein and also having at least one outlet communicating with said air and fuel passages so that a mixture of fuel from said fuel passage and air from said air passage is ejected therefrom in use; a baffle plate on which said plurality of fuel spraying devices are mounted with the outlets thereof disposed on a downstream side of the baffle plate with respect to the intended direction of air flow through the assembly in use; and a plurality of air admission apertures through said baffle plate, said apertures being disposed between said fuel spraying devices to ensure substantially uniform mixing of said fuel and air mixture and air passing through said apertures in use.

Preferably, each fuel spraying device has a plurality of outlets which extend substantially radially of said body and which are arranged, in use, to eject said fuel and air mixture from the fuel spraying device in a substantially radial direction.

Conveniently, a fuel outlet orifice of the fuel passage of each fuel spraying device is aligned with the or each said outlet in the body of the fuel spraying device.

The or each outlet in the body of each fuel spraying device may extend towards one of said air admission apertures, and may be arranged to eject said fuel and air mixture therefrom into the path of air passing through that aperture in use. However, it is also within the scope of the invention for the or each outlet to extend towards a portion of the baffle plate which separates adjacent air admission apertures.

Advantageously, the body of each fuel spraying device comprises two parts, of which a first, nozzle part contains said at least one outlet and has an abutment which engages the baffle plate on the downstream side thereof and a spigot which extends through an opening in the baffle plate, and a second, collar part is engaged with said spigot, the baffle plate being clamped between the collar part and the abutment on said nozzle part.

The combustion assembly preferably also comprises a flame tube having an inlet opening in which said baffle plate and said fuel spraying devices are disposed, said fuel spraying devices being distributed over substantially the whole area of said inlet opening.

An embodiment of the present invention will now be described, by way of example, with reference to the accompanying drawings in which:

FIG. 2 is a section on the line B—B in FIG. 3 of a fuel spraying device forming part of the assembly of FIG. 1;

FIG. 3 is a section on the line A—A in FIG. 2; and

FIG. 4 is a fragmentary view of a baffle plate forming part of the assembly of FIG. 1.

Figure 1:
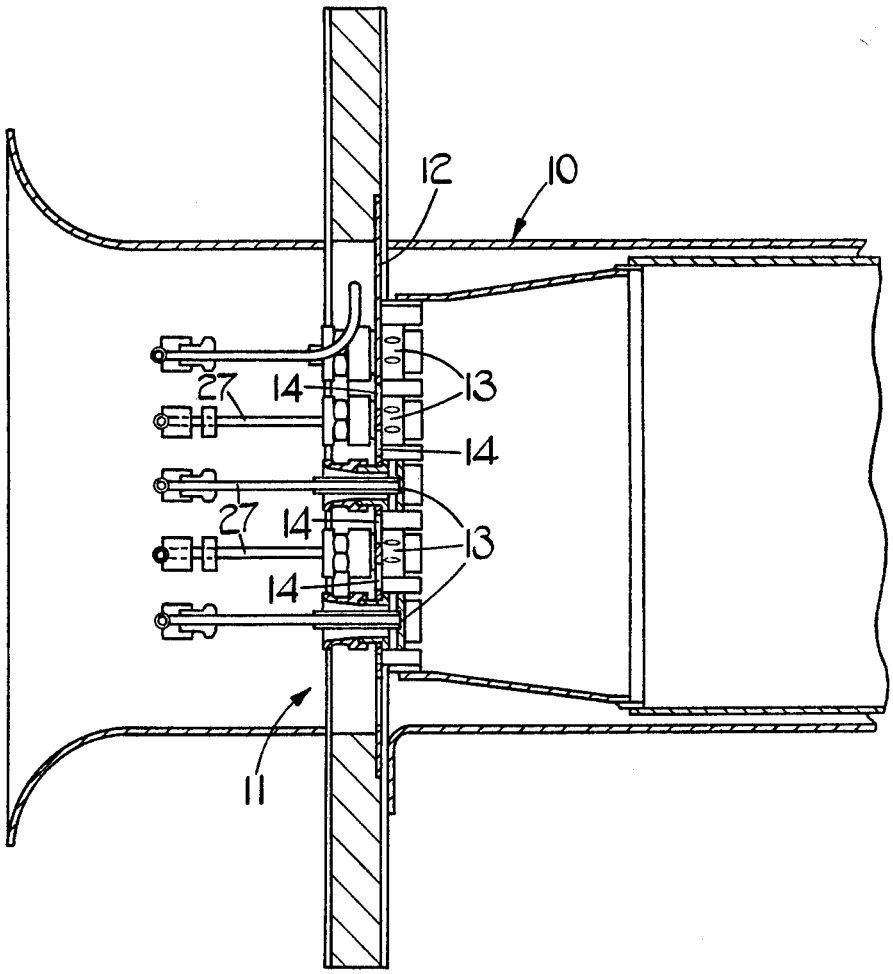
FIG. 1 is a schematic sectional view of a combustion assembly according to the present invention, applicable to a gas turbine engine.

Referring first to FIG. 1, the gas turbine engine combustion assembly comprises a tubular flame tube 10 having an axial inlet opening 11. Disposed in opening 11 is a unitary baffle plate 12 having a plurality of identical fuel spraying devices 13 mounted thereon and supported thereby. Part of the baffle plate 12 is shown is detail in FIG. 4. The fuel spraying devices 13 are distributed on an hexagonal grid over substantially the whole area of the inlet opening 11. A plurality of air admission apertures 14 extend through the baffle plate 12, and are disposed between the fuel spraying devices 13.

One of the fuel spraying devices 13 is shown in detail in FIGS. 2 and 3. This device 13 includes a body 16 constructed in two parts — a nozzle part 17 and a collar part 18. The nozzle part 17 comprises a head portion 19 and an integral hollow spigot 20 which is screw-threaded on its external surface. Six radially extending outlet passages 21 are provided in the head portion 19, and are equi-angularly spaced about an axis of the body 16. The outlet passages 21 communicate with an annular air passage 22 which extends axially through spigot 20. The air passage 22 co-axially surrounds a fuel passage 23 defined by a tubular wall 24, which wall 24 is integral with an end wall 25 of nozzle part 17 and which extends axially beyond the end of spigot 20. The fuel passage 23 communicates with the outlet passage 21, and fuel outlet orifices 26 of the fuel passage 23 are aligned with the outlet passages 21. In use, fuel from the fuel passage 23 and air from the air passage 22 are mixed within the device 13, and the resultant mixture is ejected from the outlet passages 21, in a substantially radial direction. The fuel passage 23 is connected to a fuel supply pipe 27 see FIG. 1 at the end thereof remote from end wall 25.

The collar part 18 of body 16 has an axial bore 29 extending therethrough, which bore 29 comprises a cylindrical portion 30 and an inwardly tapered portion 31 communicating therewith. The cylindrical portion 30 is screw-threaded, and engages the screw-threading on spigot 20 of nozzle part 17. The inwardly tapered portion 31 surrounds the fuel passage 23, and communicates directly with air passage 22 in nozzle part 17.

Each fuel spraying device 13 is mounted on baffle 12 in the following manner. The junction between head portion 19 and spigot 20 of nozzle part 17 forms an annular abutment, which engages the downstream side of baffle plate 12 with respect to the intended direction of air flow through the engine, and the spigot 20 extends through an opening 33 (FIG. 4) in the baffle plate 12. The collar part 18 is screwed onto spigot 20 on the upstream side of the baffle plate 12, and the baffle plate 12 is thereby clamped between collar part 18 and the said abutment on nozzle part 19.

In this particular embodiment, each fuel spraying device 13 is oriented such that each of the outlet passages 21 extends towards one of the apertures 14 surrounding the device 13. In this way, the fuel and air mixture is ejected from device 13 into the path of air passing through the apertures 14. However, in an alternative embodiment (not shown), the outlet passages 21 extend towards portions of the baffle plate 12 which separate adjacent apertures 14.

From the above, it will be apparent that fuel for the gas turbine engine is premixed with air within the fuel spraying devices 13, is ejected from the latter, and is then further mixed with air flowing through the apertures 14 in baffle plate 12. In view of the fact that the fuel outlet orifices 26 are aligned with the outlet passages 21 in each device 13, and also in view of the fact that the outlet passages 21 are arranged to eject the fuel and air mixture on the downstream side of baffle plate 12, impingement of the fuel on metal surfaces is substantially avoided. The fuel is atomised for the most part by air passing through the fuel spraying devices 13; the air passing through the apertures 14 in the baffle plate 12 can be used, however, to atomise large fuel droplets.

In addition, the disposition of the apertures 14 in baffle plate 12 ensures that substantially uniform mixing occurs between the fuel and air mixture ejected from the fuel spraying devices 13 and the air flowing through the apertures 14. In this way, fuel-rich pockets in the flame tube 10 are substantially avoided. This enables the amounts of pollutants, particularly the oxides of nitrogen, in the engine exhaust to be reduced by using a reduced temperature of combustion. It also serves to reduce the amount of cooling air required for the combustion assembly.

The applicants have found that mixing of the air and fuel improves as the percentage pressure loss across the baffle is increased. Moreover, the rate of mixing can be varied by varying the distance between each fuel spraying device and its surrounding apertures in the baffle plate.

We claim:

1. A combustion assembly comprising a plurality of fuel spraying devices, each of which includes a body having air and fuel passages therein and also having at least one outlet communicating with said air and fuel passages so that a mixture of fuel from said fuel passage and air from said air passage is ejected therefrom in use; a baffle plate on which said plurality of fuel spraying devices are mounted with the outlets thereof disposed on a downstream side of the baffle plate with respect to the intended direction of air flow through the assembly in use; and a plurality of air admission apertures through said baffle plate, said apertures being disposed between said fuel spraying devices to ensure substantially uniform mixing of said fuel and air mixture and air passing through said apertures in use, and wherein the body of each fuel spraying device comprises two parts, of which a first, nozzle part contains said at least one outlet and has an abutment which engages the baffle plate on the downstream side thereof and a spigot which extends through an opening in the baffle plate, and a second, collar part is engaged with said spigot, the baffle plate being clamped between the collar part and the abutment on said nozzle part.

2. A combustion assembly as claimed in claim 1, wherein each fuel spraying device has a plurality of outlets which extend substantially radially of said body and which are arranged, in use, to eject said fuel and air mixture from the fuel spraying device in a substantially radial direction.

3. A combustion assembly as claimed in claim 1 wherein a fuel outlet orifice of the fuel passage of each fuel spraying device is aligned with said at least one outlet in the body of the fuel spraying device.

4. A combustion assembly as claimed in claim 1, wherein said at least one outlet in the body of each fuel spraying device extends towards one of said air admission apertures, and is arranged to eject said fuel and air mixture therefrom into the path of air passing through that aperture in use.

5. A combustion assembly as claimed in claim 1, wherein said at least one outlet extends towards a portion of the baffle plate which separates adjacent air admission apertures.

6. A combustion assembly as claimed in claim 1, further comprising a flame tube having an inlet opening in which said baffle plate and said fuel spraying devices are disposed, said fuel spraying devices being distributed over substantially the whole area of said inlet opening.

* * * * *